US005727536A

United States Patent [19]

Kato

[11] Patent Number: 5,727,536

[45] Date of Patent: Mar. 17, 1998

[54] ENGINE CONTROL SYSTEM AND METHOD

[75] Inventor: Masahiko Kato, Hamamatsu, Japan

[73] Assignee: Sanshin Kogyo Kabushiki Kaisha, Shizuoka-ken, Japan

[21] Appl. No.: 725,206

[22] Filed: Sep. 23, 1996

[30] Foreign Application Priority Data

Sep. 22, 1995 [JP] Japan ..... 7-244687

[51] Int. Cl.[6] ..... F02D 41/10

[52] U.S. Cl. ..... 123/682

[58] Field of Search ..... 123/682, 673, 123/675, 492, 687

[56] References Cited

U.S. PATENT DOCUMENTS

| | | | |
|---|---|---|---|
| 4,498,441 | 2/1985 | Ohgami et al. | 123/440 |
| 4,627,402 | 12/1986 | Saito et al. | 123/440 |
| 4,628,883 | 12/1986 | Kataoka | 123/489 |
| 4,729,362 | 3/1988 | Mori | 123/492 |
| 5,241,939 | 9/1993 | Nonaka | 123/492 |
| 5,251,602 | 10/1993 | Kurihara et al. | 123/527 |
| 5,337,722 | 8/1994 | Kurihara et al. | 123/527 |

FOREIGN PATENT DOCUMENTS

| | | |
|---|---|---|
| 63-117137 | 5/1985 | Japan . |
| 63-75327 | 4/1988 | Japan . |
| 1-271628 | 10/1989 | Japan . |

*Primary Examiner*—Willis R. Wolfe
*Assistant Examiner*—Hieu T. Vo
*Attorney, Agent, or Firm*—Knobbe, Martens, Olson & Bear, LLP

[57] ABSTRACT

A feedback control system and method for operating an internal combustion engine to provide the desired air/fuel ratio under all running conditions. The feedback control operates to modify the fuel/air ratio from that achieved by a basic setting that is derived from parameters of engine performance so as to maintain the desired ratio. The feedback control adjusts the air/fuel ratio in two different modes. In a first, normal operation mode, the feedback control adjusts the air/fuel mixture supplied to all cylinders based upon feedback from a sensor connected to a single of the cylinders. In a second operational mode, when the speed of the engine is accelerating, the feedback control determines and adjusts the air/fuel mixture, but makes adjustments to all cylinders except the sensed cylinder independent of the output of the sensor. In addition, when rich adjustments to the air/fuel ratio are made, the feedback control either increases the duration of the fuel pulse or adds fuel in one or more pulses spaced in time from the base fuel pulse.

16 Claims, 10 Drawing Sheets

ENGINE CONTROL SYSTEM AND METHOD

FIELD OF THE INVENTION

This invention relates to an engine feedback control system and method, and more particularly to such a system and method wherein the feedback control adjusts the air/fuel mixture of the engine.

BACKGROUND OF THE INVENTION

Various control methodology and systems have been employed in conjunction with internal combustion engines so as to improve their performance, particularly in the areas of fuel economy and exhaust emission control. One of the more effective types of controls is a so-called "feedback" control. With this type of control, a basic air/fuel ratio is set for the engine for given engine running parameters. The final adjustment in the air/fuel ratio is made from a sensor that senses the air/fuel ratio in the combustion chamber. Adjustments are then made from the basic setting in order to bring the air/fuel ratio into the desired range.

Normally, the type of sensor employed for such feedback controls is an oxygen ($O_2$) sensor. By determining the amount of oxygen in the exhaust gases from the combustion chamber, it is possible to fairly accurately measure the actual fuel ratio that was delivered to the combustion chamber.

The system operates on a feedback-control principle, continuously making corrections to accommodate deviations from the desired ratio. Adjustments are made in stepped intervals until the sensor output goes to the opposite sense from its previous signal. For example, if the mixture was running rich, then lean adjustments are made until the mixture strength is sensed to be lean. Adjustments are then made back into the rich direction in order to try to maintain the desired ratio.

These systems do not work satisfactorily during certain periods of engine operation. For example, when the engine is accelerating, large amounts of fuel must be quickly added to the engine. Using normal feedback control, this response is not provided. In addition, when this additional fuel must be supplied to the engine, the manner by which feedback control provides the additional fuel does not always provide optimal performance.

It is, therefore, a principal object of this invention to provide an improved feedback control system for an engine.

It is a further object of this invention to provide an improved feedback control system and a method for an engine wherein the feedback control provides sufficient fuel to the engine during all phases of operation, including during engine acceleration.

SUMMARY OF THE INVENTION

This invention is adapted to be embodied in an internal combustion engine and control method. The engine comprises a number of cylinders having a combustion chamber and an air/fuel charging system for delivering an air/fuel charge to the combustion chamber for combustion therein. A combustion condition sensor is provided for sensing or detecting the air/fuel ratio in a single of the combustion chambers. A feedback control is employed for adjusting the air/fuel ratio delivered to that combustion chamber and sometimes the other nonmonitored combustion chamber, in response to the output of the combustion condition sensor.

In accordance with a method for practicing the invention, the feedback control includes a normal feedback control mode, wherein the consistency of the air/fuel mixture supplied to all cylinders is calculated from data received from the single monitored cylinder. In a second control mode, during periods of engine acceleration, the air/fuel mixture supplied to all cylinders excepting the monitored cylinder is independently calculated and not dependent upon the data from the single monitored cylinder.

In the normal operational mode, the feedback control provides fuel to each combustion chamber in spaced pulses. When additional fuel is required by the engine, the feedback control either extends the duration of the fuel pulse, or adds fuel in one or more additional pulses spaced in time from the normal fuel pulse.

Figure 9:
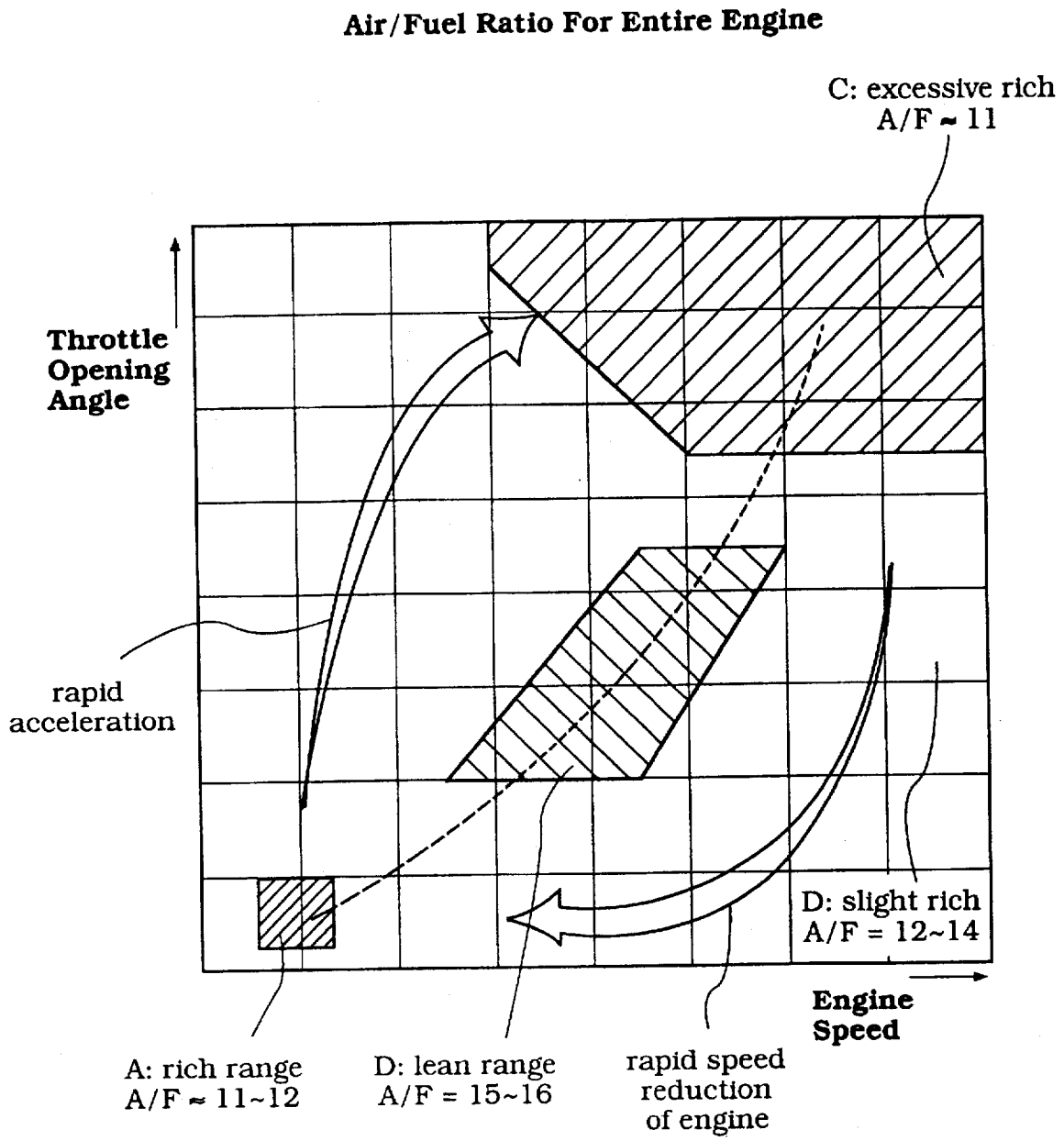
Figure 10A:
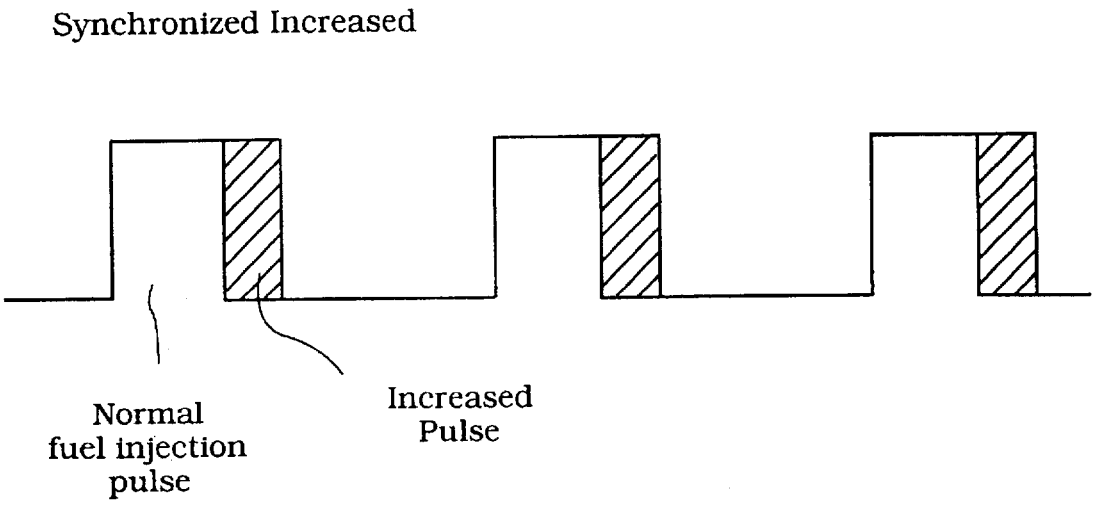
Figure 10B:
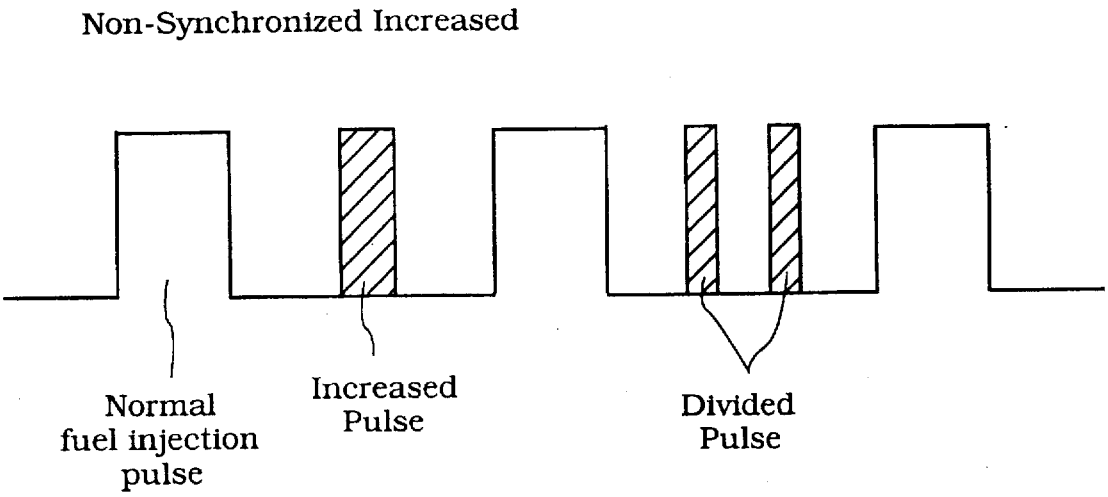

FIG. **8*a*** is a diagram illustrating the air/fuel ratio sensor output as compared to air/fuel ratio, versus time;

FIG. **8*b*** is a diagram illustrating the fuel injection volume for a single cylinder having an air/fuel sensor, versus time;

FIG. **8*c*** is a diagram illustrating the fuel injection volume for the remaining cylinders, versus time;

FIG. **8*d*** is a diagram illustrating the average fuel injection volume for the remaining cylinders, versus time;

FIG. 9 is a diagram illustrating the air/fuel ratio for the entire engine during times in which the engine is idling, accelerating, decelerating, and maximum rpm conditions;

FIG. **10*a* is a diagram illustrating normal pulse fuel addition to the engine, and further illustrating increasing the fuel addition through a synchronized prolonged fuel addition pulse; and FIG. 10*b*** is a diagram illustrating normal pulse fuel addition to the engine, and further illustrating increasing the fuel addition through one or more non-synchronized fuel pulses.

DETAILED DESCRIPTION OF THE PREFERRED EMBODIMENTS OF THE INVENTION

Figure 1:
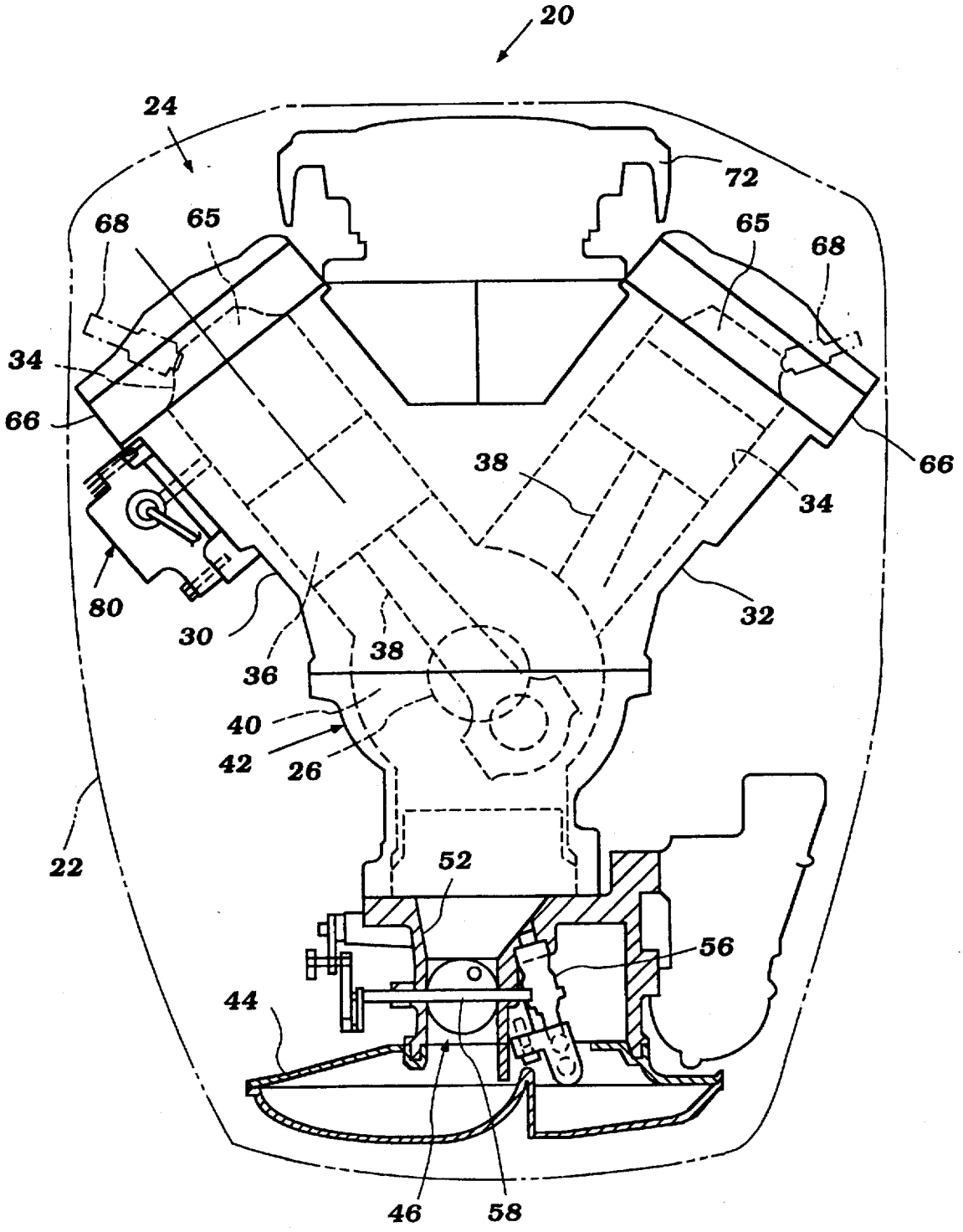
FIG. 1 is a top elevational view, with portions broken away, illustrating an outboard motor engine mounted within a housing, the engine including an oxygen sensor mounted in communication with one of the cylinders of said engine.

Referring now in detail to FIG. 1, an outboard motor 20 constructed and operated in accordance with this embodiment is illustrated. The invention is shown in conjunction with an outboard motor because the invention has particular utility in conjunction with, although not limited to, two-cycle crankcase compression engines. Such engines are normally used as the propulsion device for outboard motors. For these reasons, the full details of the outboard motor 20 will not be described and have not been illustrated. Those skilled in the art can readily understand how the invention can be utilized with any known type of outboard motor.

The outboard motor 20 includes a power head 22 that is comprised of a powering internal combustion engine, indicated generally by the reference numeral 24. The construction of the engine 24 will be described later, but it should be noted that the engine 24 is mounted in the power head 22 so that its crankshaft, indicated by the reference numeral 26, rotates about a vertically extending axis. The engine crankshaft 26 is coupled to a drive shaft that extends to drive the propeller (not shown) of the motor 20.

Figure 2:
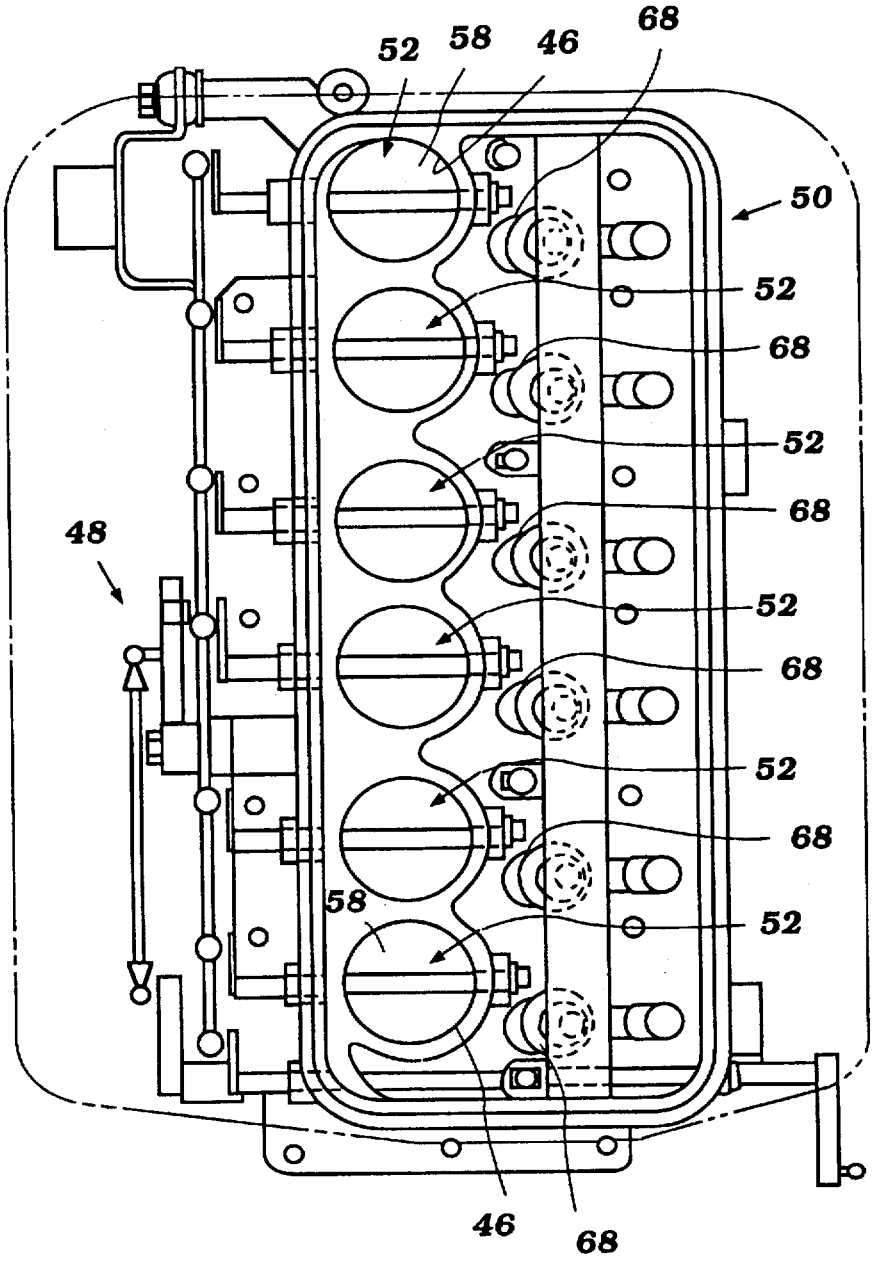
FIG. 2 is a cross-sectional view of the engine illustrated in FIG. 1 and taken perpendicular thereto, illustrating a throttle and intake mechanism for the engine.
Figure 6:
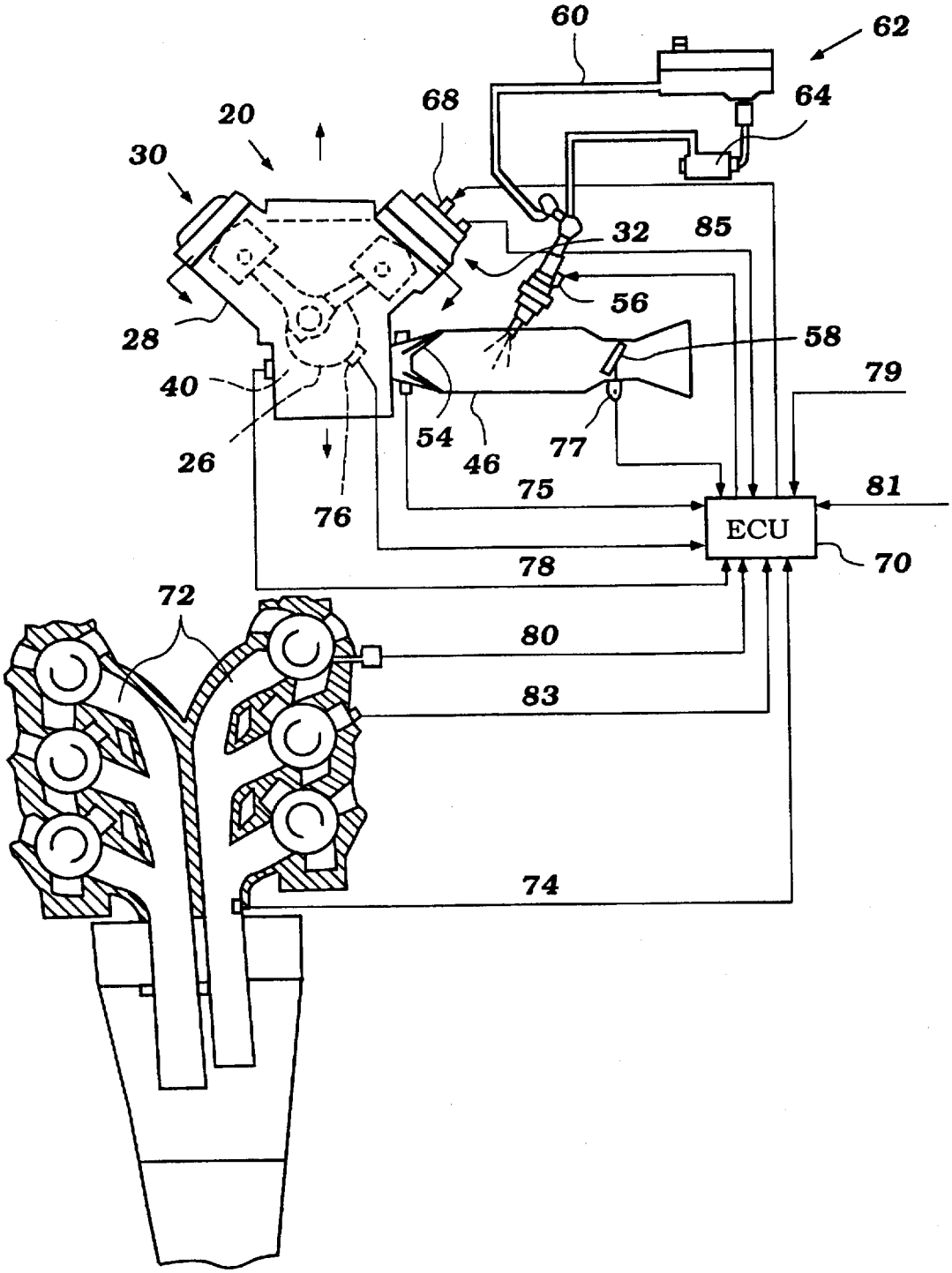
FIG. 6 diagrammatically illustrates the interconnection of various engine sensors with an engine control unit which may be used with the present invention.

Referring now primarily to FIGS. 1, 2, and 6, the engine 24 is depicted as being of the two-cycle, crankcase compression type and, in this embodiment, is of the V 6 type. Although this particular cylinder configuration is illustrated, it will be apparent to those skilled in the art how the invention may be employed with engines having other numbers of cylinders and other cylinder orientations. As will be apparent to those skilled in the art certain facets of the invention may also be employed with rotary or other ported type engines.

The engine 22 includes a cylinder block 28 having a pair of cylinder banks 30 and 32 in each of which three cylinder bores 34 are formed. A piston 36 reciprocates in each cylinder bore 34. Each piston 36 is connected by means of a connecting rod 38 to the crankshaft 26. The crankshaft 26 is, in turn, journaled for rotation within a crankcase chamber 40 in a suitable manner. The crankcase chamber 40 is formed by the cylinder block 28 and a crankcase member 42 that is affixed to it in any known manner.

As is typical with two-cycle crankcase compression engine practice, the crankcase chamber 40 is divided into compartments, the compartments associated with each of the cylinder bores 34 sealed relative to each other in an appropriate manner. A fuel-air charge is delivered to each of the crankcase chambers 40 by an induction system which is comprised of an atmospheric air inlet device 44 which draws atmospheric air through an inlet from within the protective cowling. This air is admitted to the protective cowling in any suitable manner.

FIG. 2 best illustrates an intake manifold 50 and throttle control assembly 48 which includes a throttle control linkage for controlling a throttle valve 58 positioned in respective branches 46 of the manifold. The intake manifold 50 is positioned downstream of the air inlet 44 and is operated in any known manner. The intake system discharges into intake ports 52 formed in the crankcase member 42. Reed-type check valves 54 (see FIG. 6) are provided in each intake port 52 for permitting the charge to be admitted to the crankcase chambers 40 when the pistons 36 are moving upwardly in the cylinder bore 34. These reed-type check valves 54 close when the piston 36 moves downwardly to compress the charge in the crankcase chambers 40, as is also well known in this art.

Fuel is added to the air charge inducted into the crankcase chambers 40 by a suitable charge former. As best illustrated in FIGS. 2 and 6, this charge former comprises fuel injectors 56, each mounted in the respective branches 46 of the intake manifold 50 downstream of the respective throttle valves 58. The fuel injectors 56 are preferably of the electronically operated type. That is, they are provided with an electric solenoid that operates an injector valve so as to open and close and deliver high-pressure fuel directed toward the intake port 52.

Fuel is supplied to the fuel injectors 56 under high pressure through a fuel supply system, indicated generally by the reference numeral 60 in FIG. 6. This fuel supply system 60 includes a fuel tank 62 which is positioned remotely from the outboard motor 20 and preferably within the hull of the watercraft propelled by the outboard motor. Fuel is pumped from the fuel tank 62 by means of a low pressure fuel pump 64, which may be electrically or otherwise operated.

This fuel then passes through a fuel filter, which preferably is mounted within the power head of the outboard motor 20. Fuel flows from the fuel filter through a conduit into a fuel vapor separator, which includes a float controlled valve for controlling the level of fuel in the fuel vapor separator. Any accumulated vapor will condense, and excess vapor pressure can be relieved through a suitable vent (not shown).

The fuel-air charge which is formed by the charge-forming and induction system as thus far described is transferred from the crankcase chambers 40 to combustion chambers 65. These combustion chambers 65 are formed by the heads of the pistons 36, the cylinder bores 34, and a respective cylinder head assembly 66 that is affixed to each bank 30 and 32 of the cylinder block 28 in any known manner. The charge so formed is transferred to the combustion chamber 65 from the crankcase chambers 40 through one or more scavenge passages.

Spark plugs 68 are mounted in the cylinder head 66 and have their spark gaps extending into the combustion chambers 65. The spark plugs 68 are fired by a capacitor discharge ignition system as is well known in the art. This outputs a signal to a spark coil which may be mounted on each spark plug for firing the spark plug 68 in a known manner. The capacitor discharge ignition circuit is operated, along with certain other engine controls such as the regulated fuel pressure, by an engine management ECU, shown schematically and identified generally by the reference numeral 70 in FIG. 6.

When the spark plugs 68 fire, the charge in the combustion chambers will ignite and expand so as to drive the pistons 36 downwardly. The combustion products are then discharged through exhaust ports formed in the cylinder block 28. These exhaust gases then flow from each cylinder bank 30,32 through a respective exhaust manifold 72 downwardly to an appropriate exhaust system as is also well known in the art.

Though not described in detail herein, the engine 24 preferably includes a cooling and/or lubricating system, of types known in the art.

It has been noted that the ECU 70 controls the capacitor discharge ignition circuit and the firing of the spark plugs 68. In addition, the ECU 70 controls the fuel injectors 56 so as to control both the beginning and duration of fuel injection and the regulated fuel pressure, as already noted. The ECU 70 operates on a strategy for the spark control and fuel injection control 56 as will be described.

So as to permit engine management, the ECU 70 employs a number of sensors. Some of these sensors are illustrated in FIG. 6 either schematically or in actual form, and others are not illustrated. It should be apparent to those skilled in the art, however, how the invention can be practiced with a wide variety of control strategies other than or in combination with those which form the invention.

An exhaust sensor assembly is positioned in an exhaust passage within the exhaust manifold 72. A crankshaft position sensor 76 which senses the angular position of the crankshaft 26 and also the speed of its rotation. A crankcase pressure sensor 78 may also provided for sensing the pressure in the individual crankcase chambers 40. Among other things, this crankcase pressure signal may be employed as a means for measuring intake air flow and, accordingly, controlling the amount of fuel injected by the injector 56, as well as its timing.

A temperature sensor 75 may be provided in the intake passage downstream of the throttle valve 58 for sensing the temperature of the intake air. In addition, the position of the throttle valve 58 is sensed by a throttle position sensor 77. An atmospheric pressure sensor 79, cooling water temperature 81, engine temperature sensor 83, and inner cylinder pressure sensor 85 are also provided. There may also be a knock detector, battery voltage detector, starter switch detector and engine kill switch detector, among others.

The types of sensors which may be utilized for the feedback control system provided by the ECU 70 are only typical of those which may be utilized in conjunction with the invention. Additional sensors known in the art may be utilized.

The invention deals primarily with the feed back control utilizing an oxygen sensor 80. For that reason, further details of the description of the components of the engine and outboard motor that have no particular importance in conjunction with the understanding of the construction and operation of the feed back and related control and thus have been omitted.

Figure 3:
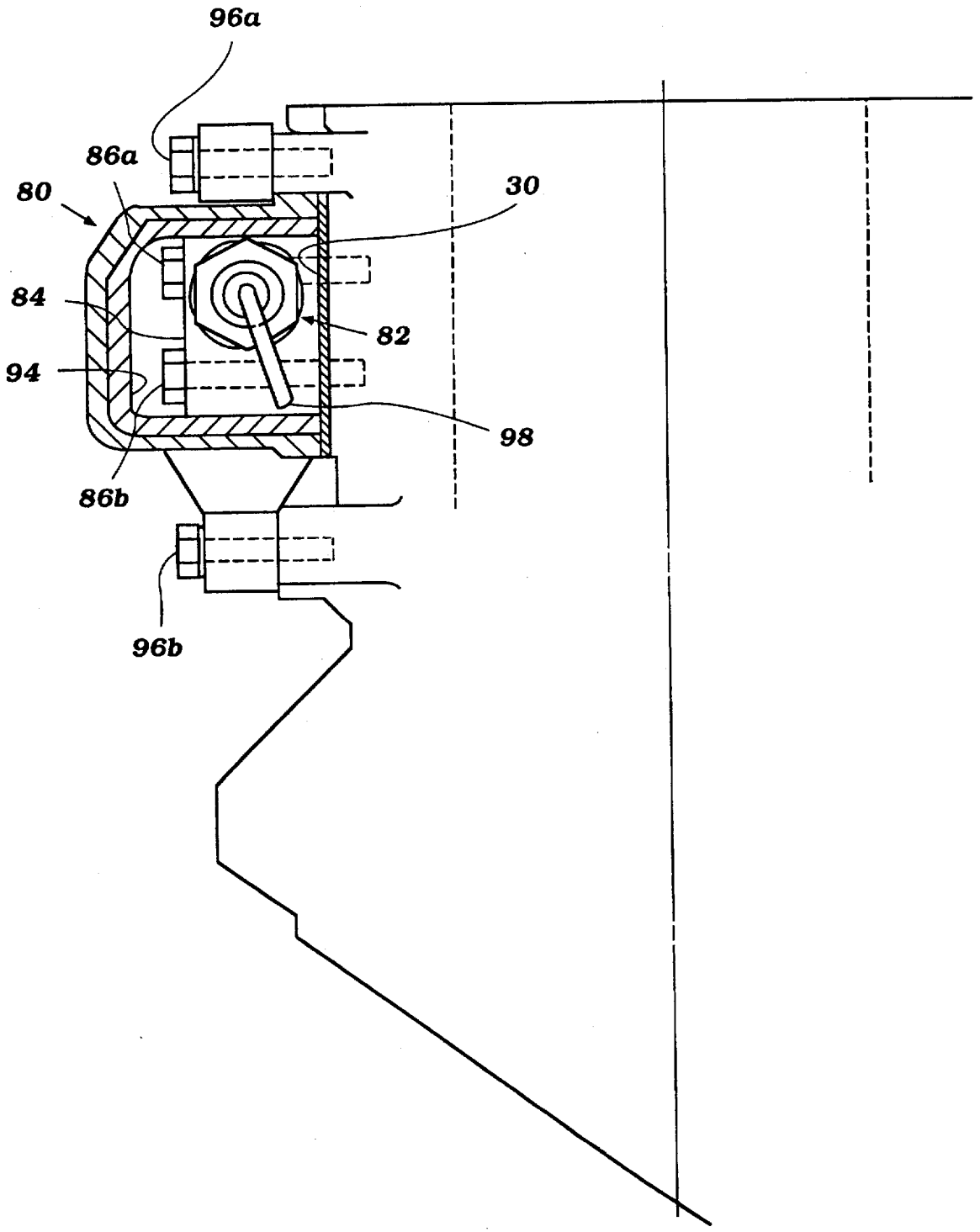
FIG. 3 is a partial enlarged view of the engine illustrated in FIG. 1 illustrating an end of the oxygen sensor.
Figure 4:
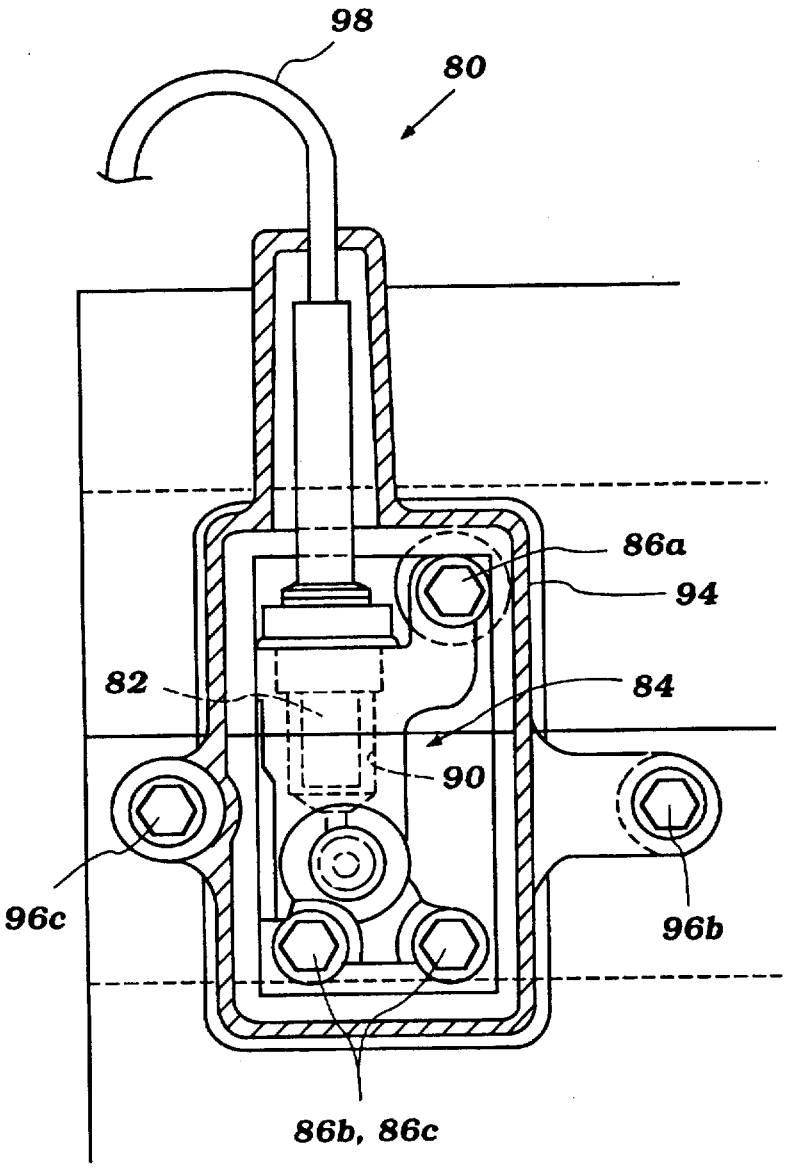
FIG. 4 is side view illustrating the sensor of FIG. 3.
Figure 5:
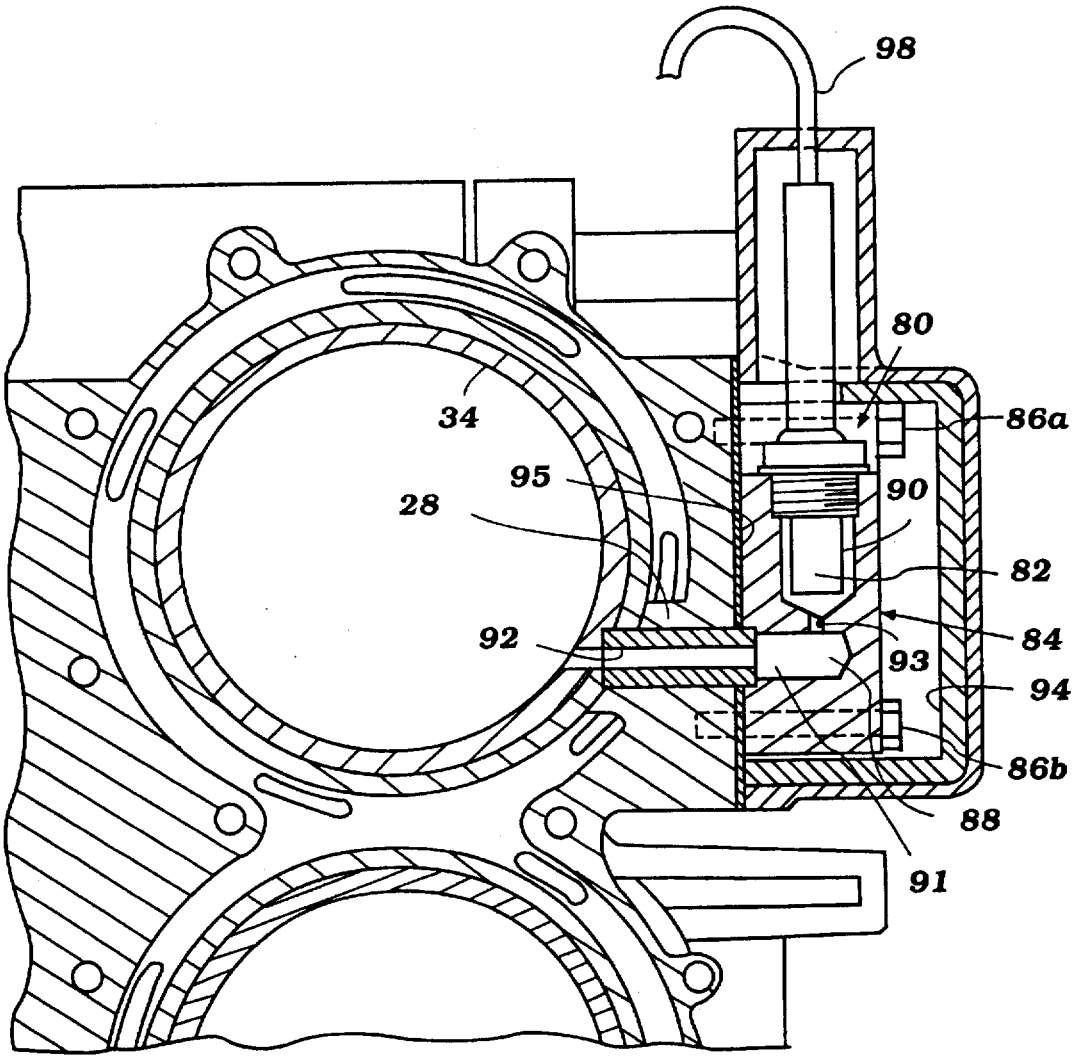
FIG. 5 is a top view, in partial cross-section, of the sensor of FIG. 3.

The sensor assembly 80 has a construction as best shown in FIGS. 3–5.

The sensor 80, in this case an oxygen ($O_2$) sensor, has its sensing portion 82 mounted within a fitting 84. The fitting 84 has a threaded connection for engagement with the sensor 80. The fitting 84 is connected to the engine block 28 with bolts 86*a*, 86*b*, 86*c*. As best illustrated in FIG. 5, the fitting 84 has a passage 88 therethrough extending in communication with the chamber 90. The passage 88 includes a first enlarged region 91 in alignment with a passage 92 extending through the block 28 in communication with the exhaust passage for the cylinder, and a second narrower portion 93 leading to the chamber 90 and extending generally perpendicular to the enlarged region 91.

A protective guard 94 extends around the fitting 84 and sensor 80, protecting them from damage. The guard 94 is connected to the block 28 with bolts 96*a*, 96*b* or similar means of attachment. An isolation gasket 95 separates the fitting 84 from the engine block 28.

The sensor portion 82 is formed as well-known in the art. As an example, the sensor portion 82 may include a platinum-plated glass tube having a hollow center. In this type of sensor 80, an electrical heater extends in to a hollow center along the centerline of the sensor and communicates with the ECU through a shielded conductor 98. As is known, the element 80 provides an output signal indicative of the oxygen content in the exhaust gas, and thus provides an indicator whether the fuel/air mixture is stoichiometric or not. The actual constituency of the sensor 80 may be of any desired type utilized in this control art.

In the embodiment illustrated, the oxygen or combustion condition sensor 80 has been positioned in direct registry with the combustion chamber or exhaust port of one of the cylinders, namely cylinder number 1. This system thus senses the combustion condition, i.e., air/fuel ratio, in only one combustion chamber and controls all remaining combustion chambers as well as that chamber from the output of this single sensor 80.

Preferably, the oxygen sensor 80 is positioned so as to communicate directly with the combustion chamber either through the wall of the cylinder bore or into the exhaust manifold portion serving that cylinder. However, to facilitate positioning and still obtain this result, it may be possible to mount the sensor 80 in a common portion of the exhaust system.

Referring to FIG. 6, the ECU 70 and its input and output signals are illustrated, including the output signals to the fuel injectors 56 and the spark plugs 68 for controlling the time of beginning of injection of each of the fuel injectors 56, the duration of injection thereof and also the timing of firing of the spark plugs 68. In addition, each cylinder is provided with a respective detector which is associated with the crankshaft and indicates when the respective cylinder is in a specific crank angle. This may be such a position as bottom dead center (BDC) or top dead center (TDC). These sensors cooperate along with the basic crank angle position sensor 76 and provide indications when the respective cylinders are in certain positions as noted.

In addition to those inputs noted, various other ambient engine or related inputs may be supplied to the ECU for the engine management system.

ECU may include a memory containing maps for control during certain phases of nonfeedback control. For example, the ECU 70 may also control, in addition to the fuel injectors 56 and the firing of the spark plugs 68, the fuel pump the lubricating pump and the like for the engine 24. Obviously, those skilled in the art will understand how these various controls cooperate with the components of the engine to provide their control, as will become apparent.

The outputs from the engine speed determination and throttle opening or load are sent to a number of calculating sections in the ECU 70. These include a section that computes the ignition timing for each cylinder. This information is derived from an appropriate map such as may be reserved in the aforenoted memory and is based upon the time before or after top dead center for each cylinder. By taking this timing and comparing it with the actual crankshaft rotation, the appropriate timing for all cylinders can be calculated.

In addition, the basic maps aforereferred to also contain an amount of fuel required for each cylinder for the sensed engine running conditions. This is in essence a basic fuel injection amount computation. This computation may be based either on fuel volume or duration of injection timing. Air flow volume and other factors may be employed to set the basic fuel injection amount.

The ECU 70 sets basic fuel injection amount and timing determined by engine speed and load, and once the system is operating and the oxygen sensor 80 is at its operating temperature, the system shifts to a feedback control system. This feedback control system is superimposed upon the basic fuel injection amount and timing and spark timing so as to more quickly bring the engine to the desired running condition.

As has been noted, the output or combustion condition in one combustion chamber only is sensed and that signal is employed for controlling the other cylinders. There are some times when cylinders are disabled to reduce the speed of the engine for protection. The ECU 70 ensures proper control also during these times even if the disabled cylinder is the one with which the sensor is associated.

The ECU 70 may be programmed to include various operational modes, each of which is activated dependent primarily upon the results of the inputs from the various sensors.

The available modes may include a start-up mode when the engine is first started, an oxygen sensor feedback mode under which feedback control will be accomplished, and a study or memory mode where data from engine running conditions is stored.

Another potential mode is the operation when a cylinder or more is being disabled to affect speed control and protection for a so-called "limp home" mode. The ECU 70 may also include two time programs or control loops: loop 1, which repeats more frequently than the other loop (loop 2). These alternative control loops are utilized so as to minimize the memory requirements and loading on the ECU 70. For example, loop 1 may comprise the reading of the output of certain switches such as a main engine stop or kill switch, a main switch for the entire circuit, or a starter switch. The purpose for reading these switches is to determine whether the engine is in the starting mode or in a stopping or stopped mode so as to provide information for determining the proper control mode for the ECU 70 to execute.

If loop 1 is not being performed or if it has been completed, the ECU 70 moves to determine if the time has run so as to initiate the loop 2 control routine. If the system is operating in the loop 2 mode of determination, the ECU 70 then moves to read the output from certain additional switches, such as the lubricant level switch, the neutral detector switch and the DES output switch to determine if any of these specific control routines conditions are required. The ECU 70 determines if the system should be operating under normal control or misfire control. If no misfire control is required because none of the engine protection conditions are required, then the ECU 70 determines from the basic map the computation of the ignition timing, injection timing and amount of injection per cylinder. As has been previously noted, this may be determined from engine speed and engine load with engine load being determined by throttle valve position.

If it is determined that the misfire or speed control is required by eliminating the firing of one cylinder, the ECU 70 determines from a further memory map the ignition timing and injection timing and duration.

Once the basic ignition timing and injection timing and amount are determined, the ECU 70 computes certain compensation factors for ignition and/or injection timing. These compensation factors may include such outputs as the altitude pressure compensation and engine temperature compensation determined by the outputs from the respective sensors. In addition, there may be compensation for invalid injection time and ignition delay.

The ECU 70 may include a control routine to determine if the engine 24 is moving in a forward or a reverse direction. If it is determined that the engine is rotating in a reverse direction, the ECU 70 initiates engine stopping. This may be done by ceasing the ignition and/or discontinuing the supply of fuel.

If the engine continues to be operated, the ECU 70 determines if the immediately detected cylinder is cylinder number 1. As has been noted, cylinder number 1 is the cylinder with which the oxygen sensor 80 is associated.

Once cylinder number 1 is the cylinder that is being immediately sensed, the ECU 70 determines if the engine is operating in a cylinder disabling move. If it is not, the ECU 70 clears the register of the disabling information because the engine is now operating under a normal condition. If, however, it is determined that the system is operating in the disabled cylinder mode so as to reduce or control maximum engine speed, the ECU 70 determines if the pattern by which the cylinder is disabled should be changed. As has been previously referred to, if the engine is being operated with one or more cylinders disabled so as to limit engine speed for the limp home mode, it is desirable to only disable a given cylinder for a predetermined number of cycles. If the disabling is extended, then on returning to normal operation the spark plug in the disabled cylinder may be fowled and normal operation will not be possible or will be very rough.

If it is not time to change the disabled cylinder or if the disabled cylinder number is changed, the ECU 70 then sets up or updates the information as to the cylinder which is being disabled and the ignition disabling for that cylinder. The ECU 70 then actually steps up the ignition pulse for the disabled cylinder and ensure that the cylinder will not fire and ensures that the disabled cylinder will not receive fuel from the fuel injection.

The ECU 70 may also include a control routine that is employed so as to stop the engine if the engine is running too slow. When the ECU 70 determines that the engine is running too slow and fouling will occur to cause stalling, the engine is shut down before that occurs.

The ECU 70 further includes a feedback control range which exists when the engine temperature and specifically the oxygen sensor 80 temperature is sufficient so as to provide reliable information by which feedback control may be enjoyed. Operation of the ECU 70 in feedback control mode may also be dependent on other requisite engine parameters, such as engine rpm. If the ECU 70 determines the engine is operating in a condition allowing oxygen feedback control, it makes the necessary feedback control compensations based upon the output of the oxygen sensor 80, as described below.

Figure 7:
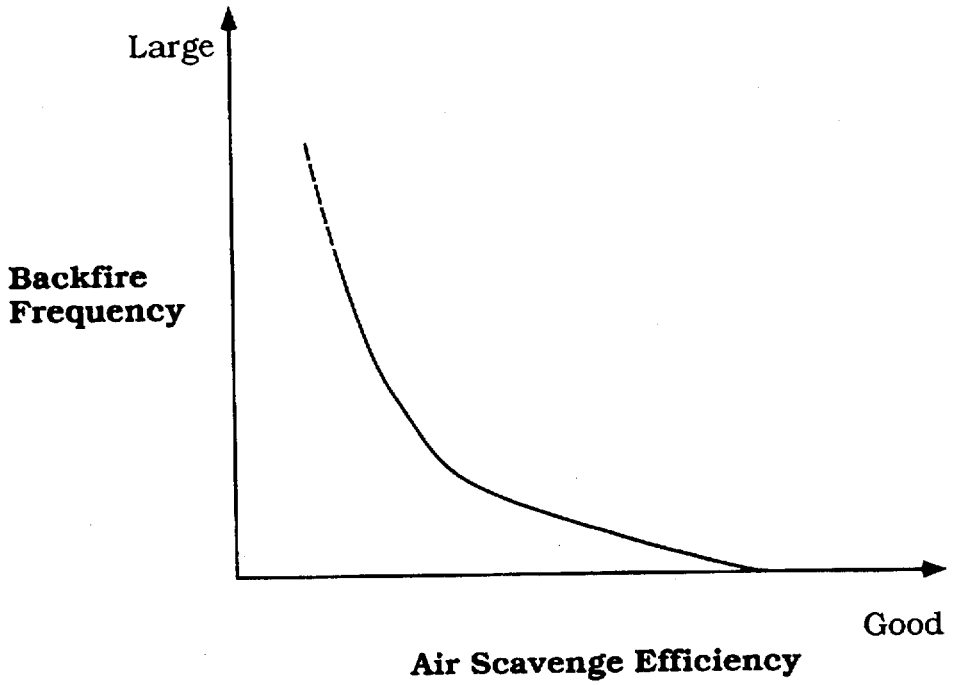
FIG. 7 is a diagram illustrating backfire frequency of the engine with respect to air scavenging efficiency.

When the engine is originally started and before the engine, or more specifically the oxygen sensor 80 is at its operating temperature, there is an open ECU 70 engine control based upon a preset map or control strategy. FIG. 7 illustrates, at least in part, why adjustments to the air/fuel ratio are necessary. As indicated therein, when air scavenge efficiency is improved, backfire frequency decreases. In addition, FIG. 9 illustrates the various air/fuel ratios which must be supplied to the engine 24 at various operational phases.

Figure 8A:
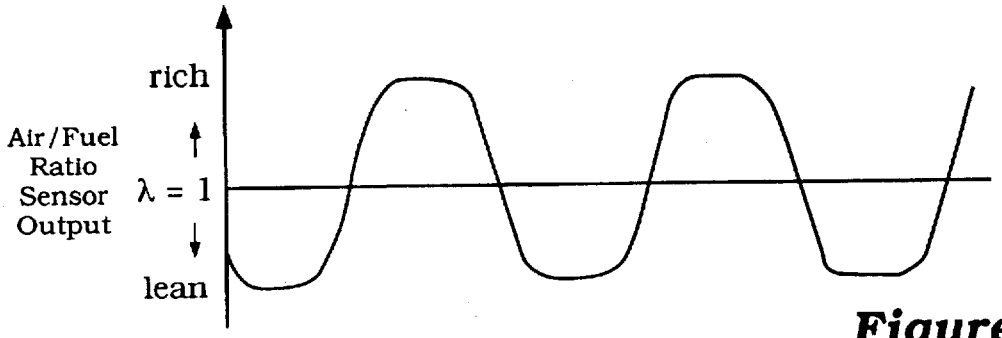

When the oxygen sensor 80 begins to reach its operating temperature it provides an output a signal, normally in the form of an output voltage. As illustrated in FIG. 8*a*, the engine 24 is basically run on the lean side during initial startup. When there is a switch-over to the feedback control the ECU 70 employs a normal control strategy in which the fuel amount will be increased. This fuel increase will then be continued to occur in steps until the change in voltage of the oxygen sensor output causes the ECU 70 to begin the process of bringing air/fuel ratio back from rich to lean.

FIG. 8*a* illustrates the fuel injection volume for the feedback control strategy of the ECU 70. Beginning near the left of the time line in FIG. 8*a*, the engine is normally operating at a lean air/fuel mixture when the feedback control condition first becomes operable. At that time "rich" air/fuel adjustments are normally made in accordance with a normal feedback control until the mixture is sensed by the sensor 80 to be too rich. When the mixture is richer than stoichiometric, the control strategy is to provide a lean proportional fixed incremental increase or "step" in fuel injection amount (i.e. decrease in fuel) in order to make the mixture lean.

Most commonly, the first adjustment in either the lean or rich direction is a large incremental step which varies in accordance with a map depending upon engine speed. Once the initial proportional adjustment is made, then the program waits a time interval, after which smaller incremental steps are then employed, these incremental step values also derived from a map. Once the mixture is sensed by the sensor 80 a crossing stoichiometric again, subsequent adjustments to the mixture are made by the ECU 70 in the opposite direction.

Figure 8B:
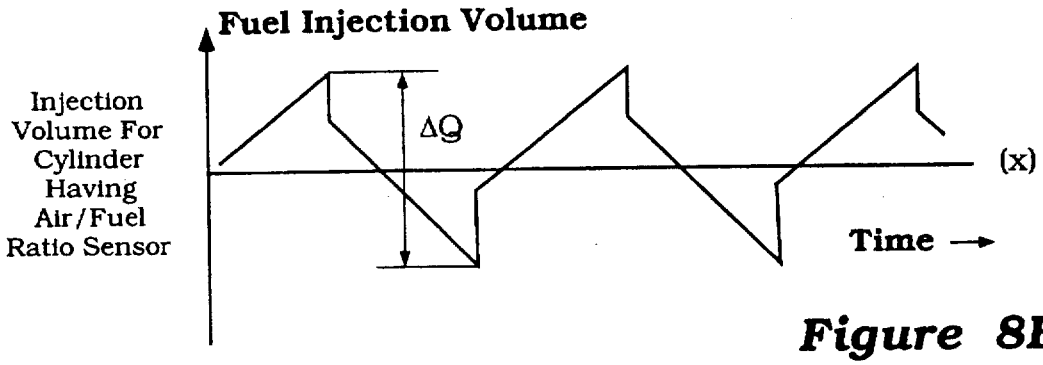

FIG. 8*b* illustrates the change in fuel injection volume to the cylinder which is monitored by the sensor 80. As illustrated, when the mixture is lean, the fuel injection amount to the cylinder is increased. Once the mixture is sensed as rich, the ECU 70 makes a first large drop in fuel injection amount, followed by smaller incremental decreases (shown in approximate fashion by the diagonal line). The total change in injection volume to the cylinder between greatest and least injection volume is $\Delta Q$, corresponding to a maximum differential sensor 80 output.

In accordance with the present invention, the ECU 70 controls the air/fuel mixture to the other (i.e., nonmonitored) cylinders as follows. Preferably, in a normal or first mode of feedback control operation, the air/fuel mixture to the nonmonitored cylinders is based upon feedback from the sensor 80 in the monitored cylinder. In a second mode of ECU 70 feedback control, the air/fuel mixture to the nonmonitored cylinders is not based upon the feedback from the sensor 80 from the monitored cylinder.

In the first mode of feedback control operation, the air/fuel mixture supplied to the monitored cylinder is controlled by the ECU 70 as described above, utilizing feedback from the oxygen sensor 80. In this mode of operation, the air/fuel mixture supplied to the remaining (nonmonitored) cylinders is dependent on the same monitor feedback.

Preferably, this first operational mode is utilized at all times under which the feedback control is operational, except during periods of engine acceleration. Thus, as a first criteria, the feedback control mode must be operational (as described above, based on, for example, the oxygen sensor 80 reaching sufficient operational temperature). As a second criteria, the first mode of the feedback control mode is operational when the engine 24 is running at or near constant velocity, or is decelerating.

Figure 8C:
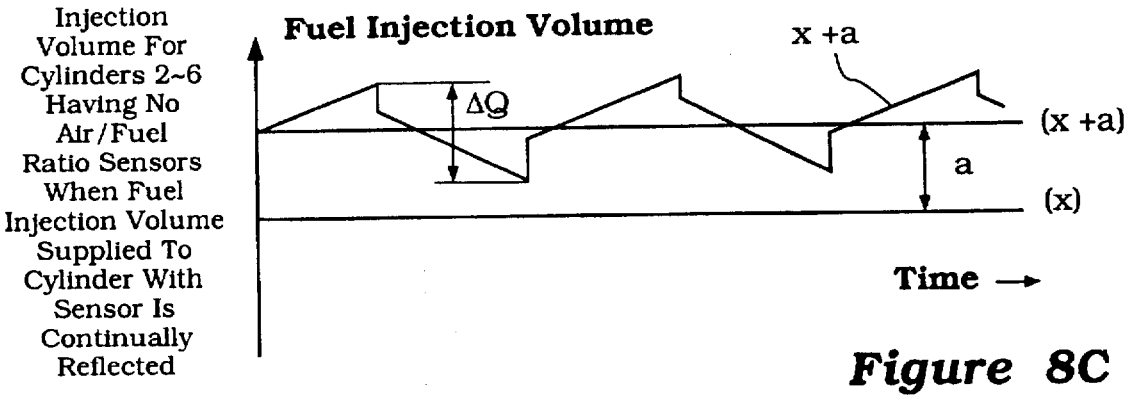
Figure 8D:
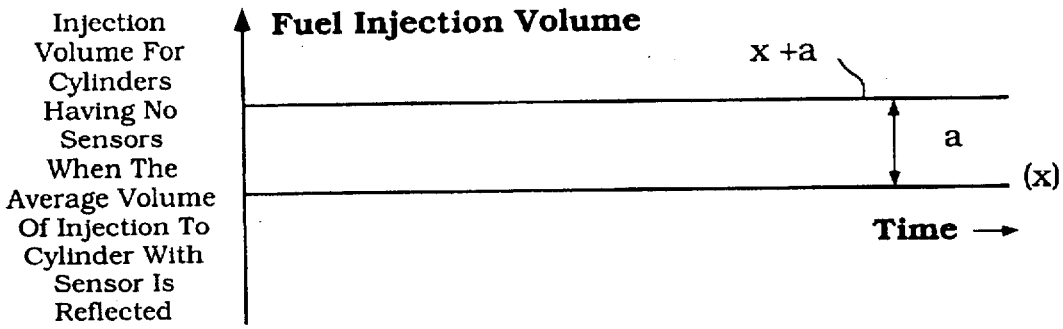

In this normal feedback control mode, the air/fuel mixture to the monitored cylinder is controlled by the ECU 70 based on sensor 80 output as described above. The air/fuel mixture which is supplied to the other cylinders is calculated from an ECU 70 map based on the sensor 80 output. This map provides a calculated total engine air/fuel mixture based on the sensor 80 output. Fuel is supplied to each of the nonmonitored cylinders based on the total fuel and air amounts which must be applied to the engine to achieve the desired engine air/fuel mixture. FIGS. 8*c* and 8*d* illustrate the fuel injection volume to the remaining nonmonitored cylinders.

In a second mode of the feedback control mode of the ECU 70, the air/fuel mixture which is supplied to the nonmonitored cylinders is independent of the output from the sensor 80. This second mode is operational when the engine 24 is accelerating.

In the second mode of the feedback control, the air/fuel mixture for the remaining nonmonitored cylinders is determined from an ECU 70 map and controlled independent of the output from the sensor 80. This map provides engine air/fuel mixture data for different engine acceleration rates and other engine operating conditions. Based on the engine acceleration rate (as determined by the rate of increase in crank-angle rotation as measure by sensor 76) and these other engine operating conditions, the ECU 70 determines the desired engine air/fuel ratio. The ECU 70 provides each nonmonitored cylinder with fuel dependent on this desired engine air/fuel ratio.

During periods of engine acceleration, additional fuel over the normal amount of fuel must be supplied to the engine 24. As illustrated in FIGS. 10*a* and 10*b*, when the feedback control is operating to increase the amount of fuel supplied to the engine, such as when the feedback control is operating in the second mode, fuel is added to the air stream entering the engine for making the air/fuel mixture rich in one of three manners.

As illustrated in FIG. 10*a*, there is a normal or base pulse of fuel supplied to the air charge provided to each cylinder during each revolution of the crankshaft 26 at a given engine rotational speed. In accordance with a first embodiment of the present invention, when the ECU 70 determines that the amount of fuel supplied to the cylinders must be increased, the fuel injection pulse is extended in duration. Additional fuel for engine acceleration is thus added, as best illustrated in FIG. 10*a*, in synchronous fashion with the base fuel pulse.

In a second embodiment of increasing the amount of fuel supplied to the air charge, fuel is added in addition to the base fuel pulse in a pulse spaced in time from the base fuel pulse. As best illustrated in FIG. 10*b*, the additional fuel may be added in one or more fuel pulses which are spaced in time from the base fuel pulse.

The manner by which fuel is added as illustrated in FIGS. 10*a* and 10*b* may be understood by the following example. If the engine 24 is idling, a pulse of fuel is added to the air charge provided to each cylinder for each rotation of the crankshaft. When the engine accelerates, additional fuel must be supplied to each cylinder. In accordance with the fuel addition embodiment illustrated in FIG. 10*a*, the base fuel pulse is extended in duration. In accordance with the fuel addition embodiment illustrated in FIG. 10*b*, one or more additional fuel pulses are made into the air stream in addition to the base fuel pulse.

Of course, the foregoing description is that of preferred embodiments of the invention, and various changes and modifications may be made without departing from the spirit and scope of the invention, as defined by the appended claims.

What is claimed is:

1. An internal combustion engine comprising a first combustion chamber and at least one additional combustion chamber, an air/fuel charging system for delivering an air and fuel charge to said combustion chambers for combustion therein, a combustion condition sensor for determining the air/fuel ratio solely corresponding to said first combustion chamber, feedback control means for adjusting the air/fuel ratio delivered to said combustion chambers in response to the output of said combustion condition sensor, said feedback control means having a first operational mode and a second operational mode for adjusting the air/fuel ratio, said feedback control means changing the air/fuel ratio in said first operational mode in all combustion chambers of said engine based upon feedback from said sensor.

2. An internal combustion engine as set forth in claim 1, wherein the feedback control means sets a basic air/fuel ratio and the combustion condition sensor is employed to adjust the ratio from the basic air/fuel ratio.

3. An internal combustion engine as set forth in claim 2, wherein the basic air/fuel ratio is initially set based on engine running conditions.

4. The internal combustion engine in accordance with claim 1, wherein said second operational mode is utilized when the speed of said engine is accelerating and said first operational mode is used at all other times.

5. An internal combustion engine as set forth in claim 1, wherein in said second operational mode said feedback control means serves to adjust said air/fuel ratio in said first combustion chamber based on feedback from said sensor, but adjusts said air/fuel ratio to all other combustion chambers independently of the output of said sensor.

6. An internal combustion engine comprising a first combustion chamber and at least one additional combustion chamber, an air/fuel charging system for delivering an air and fuel charge to said combustion chambers for combustion therein, a combustion condition sensor for determining the air/fuel ratio in only said first combustion chamber, feedback control means for adjusting the air/fuel ratio delivered to said combustion chambers in response to the output of said combustion condition sensor, said feedback control means having a first operational mode and a second operational mode for adjusting the air/fuel ratio, wherein in said second operational mode the amount of fuel supplied to all combustion chambers excepting said first combustion chamber is dependent upon an air/fuel mixture determined independently of feedback from said sensor.

7. An internal combustion engine as set forth in claim 6, wherein said air/fuel mixture is determined by a map in said feedback control.

8. An internal combustion engine as set forth in claim 7, wherein said air/fuel mixture from said map is based on engine acceleration parameters.

9. A method of operating an internal combustion engine comprising a first combustion chamber and a sensor for determining the air/fuel ratio in said first combustion chamber, at least one other combustion chamber and an air/fuel charging system for delivering an air and fuel charge to said combustion chambers, said method comprising the steps of:

determining an air/fuel ratio corresponding to said first combustion chamber with said sensor;

determining if said engine is in a condition of acceleration;

adjusting the ratio of air and fuel delivered to said combustion chambers in a first operational mode if said engine is determined to be in a condition of acceleration, wherein adjustments to the air/fuel mixture supplied to all combustion chambers except said first combustion chamber are made independent of feedback from said sensor; and adjusting the air/fuel ratio in a second operational mode when said engine is determined not to be in a condition of acceleration, wherein adjustments made to the air/fuel mixture supplied to all combustion chambers are based upon feedback from said sensor.

10. A method of operating an internal combustion engine as set forth in claim 9, further comprising the steps of providing a basic air/fuel ratio with a feedback control and adjusting the air/fuel ratio from the basic air/fuel ratio based upon the air/fuel ratio as determined from said sensor.

11. A method of operating an internal combustion engine as set forth in claim 9, further comprising the step of initially setting the basic air/fuel ratio based on engine running conditions.

12. A method of operating an internal combustion engine as set forth in claim 9, further comprising the step of calculating the amount of fuel supplied to all combustion chambers except said first combustion chamber from a total engine desired air/fuel ratio in said first operational mode.

13. A method of operating an internal combustion engine comprising a first combustion chamber and at least one other combustion chamber and an air/fuel charging system for delivering an air and fuel charge to said combustion chambers, and a feedback control for adjusting the amount of fuel delivered to said combustion chambers, said method comprising the steps of:

sensing an air/fuel ratio corresponding to said first combustion chamber;

determining if a speed of the engine is accelerating;

controlling said engine in accordance with a first operational mode if said engine is determined not to be accelerating by adjusting the air/fuel ratio to all combustion chambers based on the sensed air/fuel ratio corresponding to said first combustion chamber;

controlling said engine in accordance with a second operational mode if said engine is determined to be accelerating by providing additional fuel to said combustion chambers and adjusting the air/fuel ratio supplied to all but said first combustion chamber independently from said sensed air/fuel ratio of said first combustion chamber; wherein accelerating;

causing spaced first pulses of fuel to be delivered to said combustion chambers for combustion in said first operational mode; and providing additional pulses of fuel to said combustion chambers in said second operational mode.

14. The method of claim 13, further comprising the step of synchronizing said additional pulses of fuel with said first pulses.

15. The method of claim 13, further comprising the step of spacing said additional pulses from said first pulses.

16. The method of claim 15, further comprising the step of providing two additional pulses in said step of providing additional pulses of fuel, said additional pulses spaced from one another and said first pulse.

* * * * *